United States Patent [19]

Rice

[11] 3,952,837

[45] Apr. 27, 1976

[54] SIGNALING SYSTEM FOR AN ELEVATOR

[75] Inventor: Lyman A. Rice, Grafton, Wis.

[73] Assignee: Armor Elevator Company, Louisville, Ky.

[22] Filed: Nov. 1, 1974

[21] Appl. No.: 520,026

[52] U.S. Cl. ..... 187/29 R; 340/19 R
[51] Int. Cl.[2] ..... B66B 1/46
[58] Field of Search ..... 187/29; 340/19

[56] References Cited

UNITED STATES PATENTS

| | | | |
|---|---|---|---|
| 2,267,271 | 12/1941 | Edwards | 187/29 |
| 2,525,769 | 10/1950 | Bruns | 187/29 X |
| 3,506,096 | 4/1970 | Robaszkiewicz | 187/29 |
| 3,774,728 | 11/1973 | Metzler et al. | 187/29 |

*Primary Examiner*—Robert K. Schaefer
*Assistant Examiner*—W. E. Duncanson, Jr.
*Attorney, Agent, or Firm*—Andrus, Sceales, Strake & Sawall

[57] ABSTRACT

An elevator system selectively moves and stops an elevator car at a plurality of landings in response to the operation of a signaling system wherein a controlled rectifier operates with a control circuit to command the stopping of an elevator car at a floor in response to the manual movement of a call button. An electromagnet has a coil connected to the gating circuit of the remotely located controlled rectifier and includes a core element having a first end connected to a first pole of a permanent magnet and a second end providing a pivotal support to an armature removably connected to a second pole of the permanent magnet. The manual call button is connected to a flexible, resilient member which is connected to the armature at a position located between the electromagnet and the permanent magnet and provides a snap action response. Manual movement of the button from an unactuated to an actuated position provides a forward pulse while release of the button and movement from the actuated position to the actuated position provides a reverse pulse with both pulses capable of providing control signals. A shunt circuit includes a shunt projection connected to a magnetic shield and is selectively contacted by the armature when actuated to rapidly collapse the flux within the electromagnet. An alternative embodiment permits the armature to rapidly separate simultaneously from both the electromagnet core and the permanent magnet through an operating rod specially positioned between the electromagnet and the permanent magnet.

22 Claims, 8 Drawing Figures

SIGNALING SYSTEM FOR AN ELEVATOR

BACKGROUND OF THE INVENTION

This invention relates to an elevator system wherein an elevator car is selectively moved and stopped to provide service to a plurality of landings within a structure and particularly to a signaling system for use therein.

Various signaling systems have been employed within elevator control systems to provide one or more command signals indicating the desire of a passenger riding within a car to stop at a particular floor or the desire of prospective passenger located at a landing to travel in either the up or down direction. Signaling systems have also been utilized within an elevator car or elsewhere to provide a remote signal indicating an emergency condition or the like.

Some signaling systems utilized within elevator systems employ heat or moisture sensitive devices which respond to the presence of a passenger in close proximity to a sensing panel to provide an output signal. Such systems, however, may be influenced by environmental conditions including temperature and humidity and thus may not provide the reliable response that can be provided through a manually operable, force actuated push button.

The use of many previous push button type elevator signaling systems has created problems because the button could be jammed or stuck in an actuated or depressed condition either accidentally or deliberately. Because many of such previous systems utilized button actuated contacts which were selectively closed in response to button actuation to complete a circuit supplying an output pulse, the jamming of the button would provide a continued output pulse to command stoppage of a plurality of elevator cars even though a previous car had serviced all existing demand at the particular landing. In addition, many elevator signaling systems employing such button actuated contacts could provide an elevator call signal thus stopping an elevator car at a landing due to a short circuit existing across the contacts which might be caused by a fire, for example, thus providing an extremely dangerous operation.

A great variety of push button switches have been constructed for various general applications. One known push button construction for general application is shown in U.S. Pat. No. 3,537,050 issued on Oct. 27, 1970 in which one or more permanent magnets are selectively connected to a magnetic core of an induction coil through an armature circuit selectively operated by a push button. Such a system provides an output pulse to render a controlled rectifier conductive whenever the armature is separated from the magnetic core of the induction coil thereby causing a collapse of the flux therein. Another type of push button actuator utilizes a transformer type solenoid circuit in which a push button operates an actuating plunger which varies the mutual inductance between primary and secondary windings with the primary winding energized by an external source and the secondary winding providing an output indicative of the relative position of the actuating rod, such as shown in U.S. Pat. No. 2,881,402 issued on Apr. 7, 1959.

SUMMARY OF THE INVENTION

This invention relates to an elevator system in which an elevator car is selectively moved and stopped to provide service to a plurality of landings within a structure and particularly to a signaling system for use therewith.

A control circuit is operative to move and stop the car such as at selected landings or at an emergency stop position and includes a manual, force responsive signaling system which is extremely safe because it will not provide a continuous false call by a manual operator being stuck in an actuated position or by short circuiting caused by a fire or the like. A manual operator used within such a signaling system can be located within the elevator car or at a landing or other fixed control center. Specifically, a permanent magnet provides first and second magnetic poles while an output is provided by an electromagnet having a coil coupled to a core having one portion connected to the first pole of the permanent magnet by a flux conducting member. An armature member is magnetically coupled to another portion of the core and selectively to the second pole of the permanent magnet while an operator is connected to an intermediate portion of the armature member which is spaced between the core and the second pole. The operator is selectively manually actuated to move the armature member between a first position which provides a good flux conducting path between the core and the second pole and a second position to substantially reduce the conduction of flux for providing a highly desirable and distinctive signaling output pulse by the rapid variation of the flux flow indicative of the manual operation. The rapid movement of the armature quickly and substantially varies the conduction of flux such as by permitting the flux to rapidly collapse or rapidly increase within the electromagnet core to provide the output pulse.

A spring element forms a part of the operator and facilitates the snap action response upon manual operation by acting upon the intermediate portion of the armature member. The operation of the spring member upon the armature member expedites the response in overcoming the magnetic attraction of the permanent magnet and also provides the rapid separation therefrom.

A preferred form of the invention provides an operator pivotally connected to the core and includes a first portion magnetically coupled to the core and to the second magnetic pole and a second portion including a resilient member which is selectively manually actuated to rapidly vary the magnetic coupling between the first portion and the magnetic pole to provide the signaling output indicative of the manual operation.

In a highly desirable construction, the operator provides a first end rotatably connected to the core of the electromagnet and a second end magnetically attracted to and normally engaging the second magnetic pole of the permanent magnet to constitute an armature for conducting flux between the core and the magnet. An elongated flexible member provides a first end fixedly connected to an intermediate portion of the pivotal member and a second end extended for manual actuation to rapidly rotate the pivotal member and disengage the second end from the second magnetic pole to provide a signaling output. The manual release of the flexible member also permits rapid rotation of the pivotal member to engage the second end with the second magnetic pole and provide another signaling output. In the preferred embodiment, the flexible member operates as a special spring and extends from the intermediate connection with the armature laterally from the electromagnet and is spaced above the pivotal connection.

In another form of the invention, a highly desirable shunting circuit provides a shunting element which is coupled to the first pole of the permanent magnet and spaced from the second pole and positioned to be selectively engaged by the armature when transferred to an actuated position for providing a shunting path for the core of the electromagnet. In a desirable manner of construction, a pair of signaling apparatus are adjacently mounted and separated by a shielding member which is connected to the shunting element to form a part of the shunting circuit. The shielding member also provides magnetic separation between the permanent magnets utilized within the adjacent signaling apparatus.

The signaling system of the present invention can be desirably used within the control circuit to stop an elevator car in response to the manual operation of the signaling apparatus. The highly distinctive output pulse is coupled to a gating circuit of a controlled rectifier circuit which is rendered conductive in response to the voltage developed by the rapid variation in flux flowing through the circuit of the electromagnet. With such a construction, the controlled rectifier can be remotely located from the electromagnet which can have distinct advantages in case excessive heat destroys the electromagnet or shorts the leads connected thereto. The control circuit can also be constructed to provide a position sensing circuit which responds to the stopping of the elevator car such as at one of the selected landings in response to the signaling output for operating a resetting circuit to render the control rectifier nonconductive.

In an alternative embodiment, the control circuit of the elevator system includes a signaling apparatus providing a permanent magnet having first and second permanent magnetic poles and an electromagnet having a core electromagnetically coupled to an output coil for selectively providing a signaling output. A U-shaped unitary member provides first and second legs each including aligned guide openings with the first leg connecting a first portion of the core with the first pole of the permanent magnet for conducting flux therebetween. An armature member is magnetically coupled to a second portion of the core and to the second pole of the permanent magnet while an operator includes a shaft movably positioned within the guide openings and fixedly connected to the armature member. The operator includes a spring which is connected to the shaft and is selectively manually actuated to move the armature member between a first position wherein the armature is connected to the core and to the second pole and a second position wherein the armature is spaced from the core and the second pole. Thus rapid movement of the armature provides a signaling output.

A highly desirable elevator system is thus provided which includes a signaling system providing an output pulse (either a forward or reverse pulse) in response to the manual operation of a push button or the like. The controlled rectifier providing the signaling output is conveniently reset in response to the stopping of the elevator car at the proper floor even though the manual button or operator may be stuck in the actuated position. An extremely safe construction is provided by the signaling system because only movement of the armature will provide a signaling output. Such operation provides a highly desirable safety feature because a short circuit within the associated leads of the elctromagnet will not provide a signaling output even though melted or fused together which may occur when a building structure is on fire. Such a signaling system construction preferrably remotely locates the signaling controlled rectifier from the electromagnet. One desirable construction locates the controlled rectifier within the elevator hatch such as within a wireway while the electromagnet and the associated push button are located on the opposite side of a separating wall to face passengers located at a landing. Thus the signaling system will not falsely signal an elevator car to stop at a landing when flames may be present at such landing which would tend to endanger the safety of passengers riding within the travelling elevator car.

BRIEF DESCRIPTION OF THE DRAWINGS

The drawings furnished herewith illustrate the best mode presently contemplated by the inventor and clearly disclose the above advantages and features as well as others which will be readily understood from the detailed description thereof.

In the drawings.

DESCRIPTION OF THE ILLUSTRATED EMBODIMENT

Figure 1:
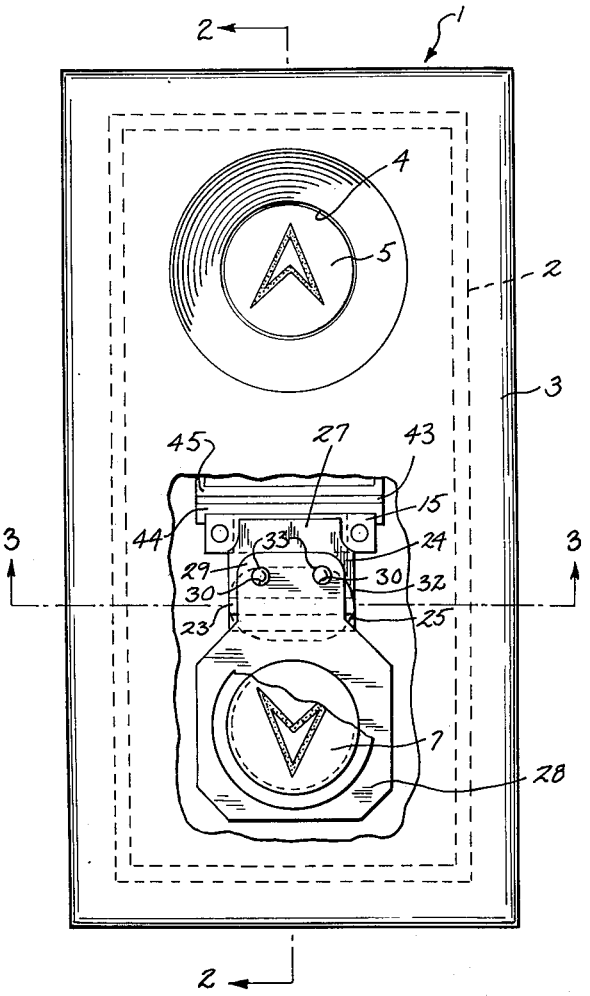
FIG. 1 is a front elevational view of a signaling assembly utilized within an elevator system.
Figure 2:
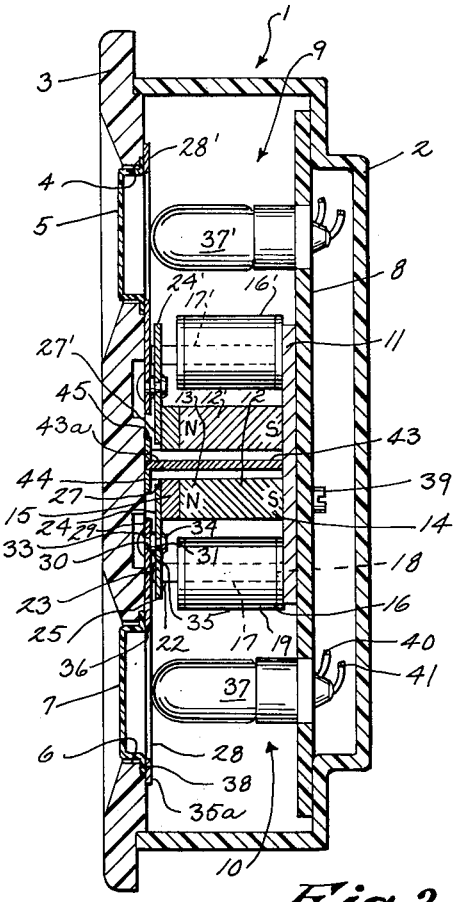
FIG. 2 is a sectional view taken along the sectional lines 2—2 in FIG. 1.
Figure 3:
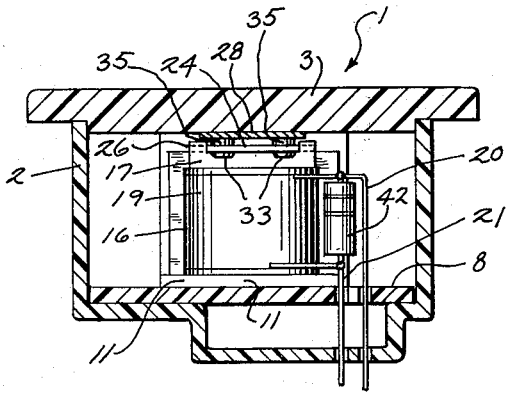
FIG. 3 is a sectional view taken along the sectional lines 3—3 in FIG. 1.

Referring to the drawings and particularly to FIGS. 1 through 3, a signaling apparatus 1 is employed within an elevator system and includes a cup shaped base member 2 removably connected to an outer face plate 3 containing an opening 4 for movably retaining an up direction push button 5 and an opening 6 for movably retaining a down direction push button 7. A mounting plate 8 is positioned within the cup shaped base member 2 and retains an up direction signaling apparatus 9 and a down direction signaling apparatus 10. Because the signaling apparatus 9 and 10 are similarly constructed, the elements and circuitry for the apparatus 10 will be described in detail while the elements and circuitry of apparatus 9 will be designated with identical members primed and further detailed description thereof is deemed unnecessary.

The base member 2, face plate 3 and the mounting plate 8 are constructed of good electrical insulating material while a flux conducting plate 11 is mounted upon the support member 8.

The signaling apparatus 10 includes a permanent magnet 12 having a permanently magnetized north pole 13 and a permanently magnetized south pole 14, the latter connected to the base member 11 and providing a magnetic flux conducting path therewith. The north pole 13 is connected to a pole piece 15 made of iron or other good magnetic flux conducting material.

An electromagnet 16 is mounted upon the base portion 11 and includes a core member 17 having a first end 18 connected in flux conducting relationship with the base member 11. A coil 19 is wound about the core element 17 and includes a plurality of turns (such as 2,000 for example) and a pair of output leads 20 and 21, such as shown in FIG. 3. The core element 17 provides a second end 22 extending beyond the coil 19 and having a pivotal support 23 for rotatably mounting an armature 24. Specifically, the armature 24 includes a first end 25 which is pivotally mounted within a recess 26 provided by the pivotal support 23 of the core element 17 while a second end portion 27 is located adjacent to the pole piece 15.

A flexible member 28 includes a first end portion 29 having a pair of spaced openings 30 which are aligned with a pair of spaced openings 31 within an intermediate portion 32 of the armature 24. A pair of rivets 33 are disposed within the openings 30 and 31 with each rivet 33 providing outer end flanges 34 and an intermediate spacer 35 for fixedly connecting the first end portion 29 of the flexible member 28 to the intermediate portion 32 of the armature 24. An outer end portion 35*a* of the flexible member 28 extends laterally from the electromagnet 16 and the permanent magnet 12 and includes a circumferential opening 36 spaced from a light 37, the latter mounted within the base plate 8. The push button 7 rests upon the end portion 35 of the flexible member 28 and is entrapped by a circumferential recess 38 formed within the face plate 3.

The electromagnet 16 and the permanent magnet 12 are conveniently secured to the flux conducting the base member 11 and the insulated plate member 8 through one or more connecting bolts and associated nuts such as at 39. The light 37 provides a pair of output leads 40 and 41 for conducting current to illuminate the filaments within the light 37. A resistor 42 is shown connected between the output leads 20 and 21 in FIG. 3.

The up direction signaling apparatus 9 and the down direction signaling apparatus 10 are separated by a highly desirable shield 43 which is mounted to the flux conducting base plate 11 and extends outwardly therefrom to provide magnetic separation between the permanent magnets 12 and 12'. An upper portion 43*a* of the shield 43 is connected to the face plate 3 and includes a pair of flux conducting projections 44 and 45 which extend laterally from the shield 43 and are spaced above the end portions 27 and 27' of the armatures 24 and 24', respectively.

Figure 4:
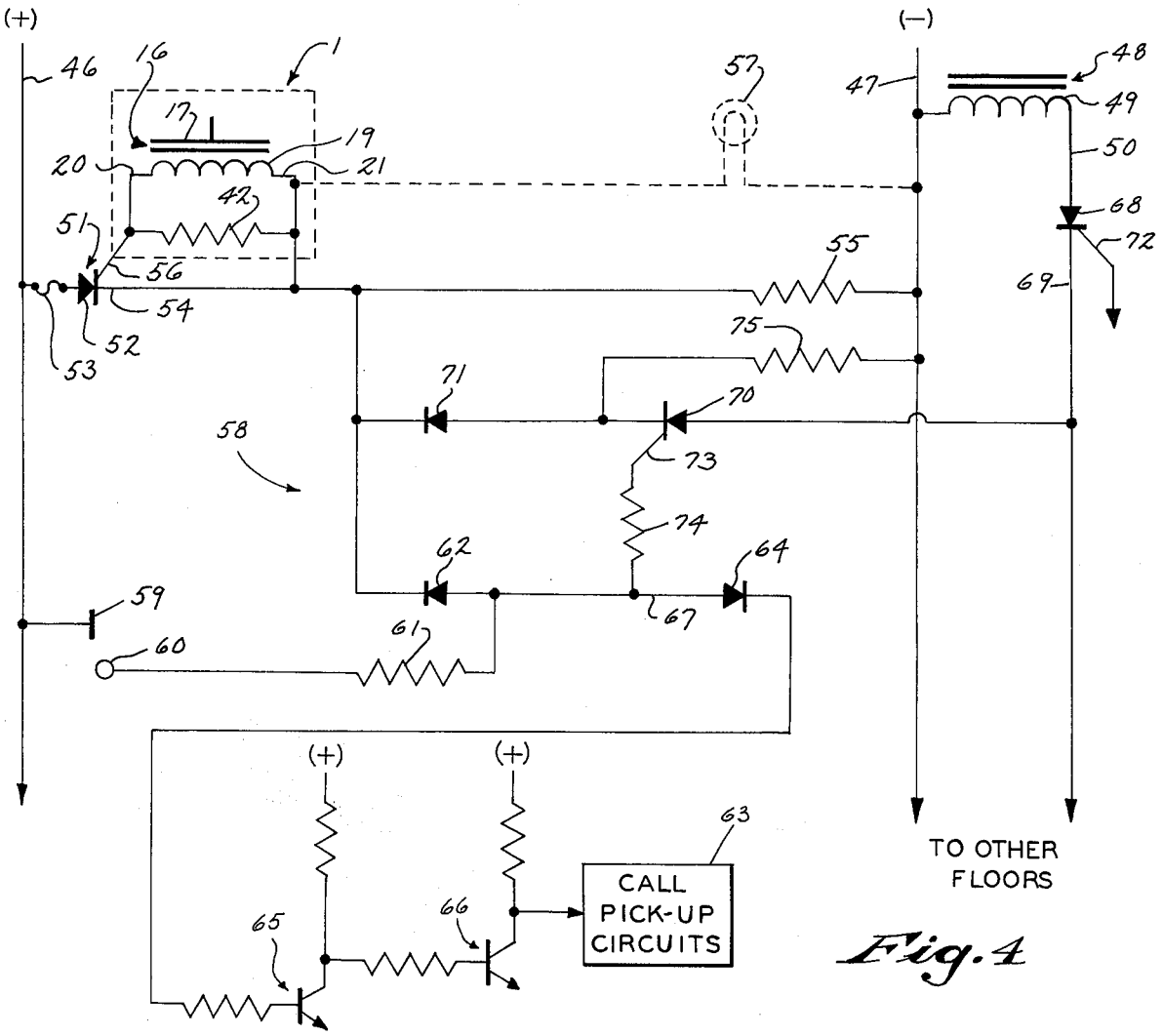
FIG. 4 is an electrical circuit schematic showing a signaling system employed with the signaling apparatus of FIG. 1.

With reference to FIG. 4, the electromagnet 16 of the signaling apparatus 1 is illustrated in circuit diagrammatic form and is connected in an across-the-line circuit configuration. Specifically, a positive potential direct current lead 46 and a reference potential lead 47 provides D.C. energizing power to the circuit while an A.C. input transformer 48 includes an output winding 49 connected between the reference lead 47 and an A.C. output lead 50. A controlled rectifier 51 provides an anode circuit 52 connected to the positive D.C. lead 46 through a temperature sensitive disconnect 53 and a cathode circuit 54 connected to the reference lead 47 through a resistor 55. A gating circuit 56 of the controlled rectifier 51 is connected to the output lead 20 supplied from the electromagnet 16 while the cathode circuit 54 is connected to the output lead 21. A light 57 is connected to the leads 21 and 47 and may be remotely located such as at a control station.

A call pick-up and cancelling circuit 58 includes a contact segment 59 connected to the positive D.C. lead 46 and represents a predetermined floor corresponding to the floor whereat the signaling assembly 1 is located. A cooperating brush 60 is connected within a selector type mechanism to move in response to the movement of the elevator car and selectively engages the contact segment 59 whenever the elevator car is located at or adjacent to the landing corresponding to the signaling apparatus 1. The brush 60 is connected in circuit to the reference lead 47 through a resistor 61, a diode 62 and a parallel connected circuit including the resistor 55 and the light 57. It is noted that the anode of diode 62 is connected to the resistor 61. The brush 60 is also connected to the call pick-up circuits 63 through the resistor 61, a diode 64 and a pair of switching transistors 65 and 66. The switching transistors 65 and 66 are connected in common emitter configuration for providing output signals at the collectors. It is noted that the anode of the diode 64 is connected to the resistor 61 through a connecting circuit 67.

A call cancelling circuit includes a controlled rectifier 68 having an anode circuit connected to the A.C. lead 50 and a cathode circuit 69 connected to the cathode circuit 54 of the control rectifier 51 through a circuit including a controlled rectifier 70 and a diode 71. A gating circuit 72 for the controlled rectifier 68 is connected to selectively receive cancelling signals from the call pick-up circuit 63 and commutate the controlled rectifier 51 off. The anode of the controlled rectifier 70 is connected to the cathode circuit 69 while the cathode is connected to the anode of diode 71. A gate circuit 73 of the controlled rectifier 70 is connected to the connecting lead 67 through a resistor 74 while a resistor 75 connects the cathode circuit of controlled rectifier 70 with the reference lead 47.

Portions of the circuit shown in FIG. 4 together with other connecting circuitry is more fully described in the U.S. Pat. No. 3,630,318 issued on Dec. 28, 1971 and assigned to a common assignee herewith and is incorporated by reference herein.

Figure 5:
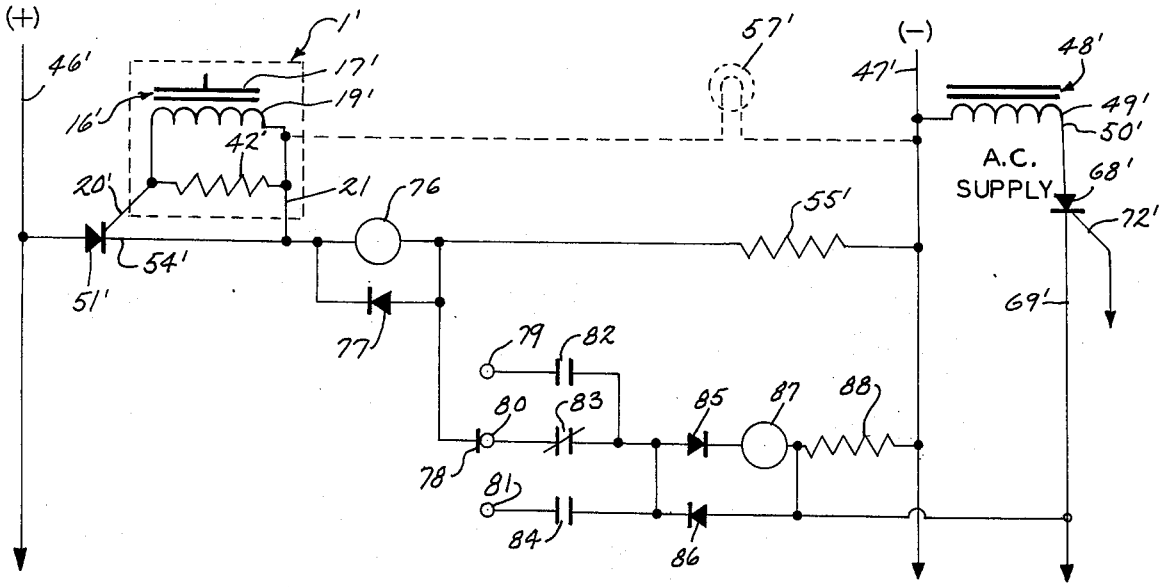
FIG. 5 is an electrical circuit schematic showing a signaling system employed as an alternative to the signaling system in FIG. 4.

With reference to FIG. 5, the electromagnet 16 of the signaling apparatus 1 is shown utilized in an alternative signaling circuit in which various components similar or identical to elements within FIG. 4 are identified with identical numbers primed. The cathode circuit 54' of the controlled rectifier 51' is connected to the resistor 55' through a floor recognition relay 76 and a parallel connected diode 77. The relay 76 is also connected to a contact segment 78 which is adapted to be selectively engaged by a plurality of brushes designated 79, 80 and 81. The brushes 79 through 81 move in response to the movement of the elevator car and selectively engage the contact segment 78 when the car is located at or adjacent to the landing corresponding to the floor relay 76 and the signaling apparatus 1. The brush 79 is connected to a normally open set of contacts 82 which selectively close in response to car movement in an upper direction. The brush 80 is connected to a normally closed set of contacts 83 which open in response to the car movement and close whenever the car is parked within the elevator system. The brush 81 is connected to a normally open set of contacts 84 which selectively close in response to the car movement in a down direction. The contacts 82, 83 and 84 are connected to an anode circuit of a diode 85 and a cathode circuit of a diode 86. The diode 85, in turn, is connected to the reference lead 47' through a car stop relay 87 and a resistor 88 while the anode circuit of diode 86 is also connected to the resistor 88 and is connected to the A.C. output lead 69'.

In operation, the preferred embodiment set forth in FIGS. 1 through 3 selectively provides an output pulse in response to the selective manual operation of button 5 or 7. Specifically, a prospective passenger located at a floor or landing selectively pushes button 7 for providing a down direction demand or indication. Pressure placed upon the button 7 creates a force upon the outer end 35*a* of the flexible member 28 which flexes or bends thus creating an upward reaction force at the end portion 29 at or near the rivets 33. Initially, the end portion 29 of the flexible member 28 remains stationery even though the end portion 35*a* begins to move or flex because the armature element 24 and particularly the end portion 27 thereof remains magnetically attracted to the permanent magnet 12 through the end piece 15. Added force placed upon button 7 provides greater flex to end portion 35*a* of the flexible member 28 thereby increasing the force provided at the rivets 33. At a predetermined force exerted at the rivets 33, the magnetic attraction between the end portion 27 of the armature 24 and the pole piece 15 is overcome thus substantially reducing magnet flux by the rotation of the armature 24 about the pivotal support 23 thereby separating the armature end portion 27 from the pole piece 15. The spring action provided by the flexing of the member 28 causes the armature 24 to rapidly separate from the pole piece 15 in a highly desirable and novel manner. Such separation of the armature 24 from the pole piece 15 operatively disconnects the magnetic flux circuit previously existing through the north pole 13 of the permanent magnet 12, the pole piece 15, the armature 24, the core element 17 of the electromagnet, the base member 11 and the south pole 14 of the premanent magnet 12. The rapid opening of the end portion 27 of the armature 24 in response to the manual operation of button 7 allows the flux within the core 17 to collapse very rapidly thus providing a distinctive output pulse to the gate circuit 56 through the output lead 20 to render the controlled rectifier 51 conductive.

As the end portion 27 of the armature 24 separates from the permanent magnet 12 by a predetermined distance, it immediately comes in contact with the projection 44 to provide a shorting path from the armature 24 through the projection 44 and the shield 43 to the base element 11. Such a flux conducting circuit essentially shunts the core element 17 to ensure that the flux collapses completely and very rapidly to provide the distinctive output pulse of desirable magnitude.

The distinctive output pulse provided by the rapid collapse of the flux within the core element 17 renders the controlled rectifier 51 conductive to provide an energizing circuit through the lamp 57 which becomes illuminated to indicate that the push button 7 has been manually actuated. The lamp 57 may be located within a common control panel within the elevator car or could consist of the lamp 37. The conduction of the controlled rectifier 51 back biases the diode 62 so that when the brush 60 engages contact 59 indicating the presence of the elevator car at or near the landing associated with button 7, an energizing circuit is provided from the positive D.C. lead 46 through the contact 59, the brush 60, the resistor 61, the connecting circuit 67 and the diode 64 to actuate the switching transistors 65 and 66 to provide an output to the call pick-up circuit 63 commanding the elevator car to stop at the landing associated with button 7. When the car has been commanded to stop, the call pick-up circuit 63 supplies a control signal to the gate circuit 72 to render the controlled rectifier 68 conductive. The signal supplied from the brush 60 to the connecting circuit 67 also renders the controlled rectifier 70 conductive for supplying rectified cancelling pulses through the controlled rectifiers 68 and 70 and the diode 71 to the cathode circuit 54 to commutate the controlled rectifier 51 off or non-conductive. In such manner, the controlled rectifier 51 and associated circuitry is reset for subsequent operation.

The circuit illustrated in FIG. 5 operates in a similar manner in that an output pulse supplied through the output lead 20' renders the controlled rectifier 51 conductive for supplying energizing current to illuminate the lamp 57' and energize the relay 76 indicating that the button 7 has been manually operated and that a call for service is existent at the corresponding floor. As the elevator car approaches the landing which contains the button, the brushes 79, 80 and 81 come in contact with the segment 78 for providing an energizing circuit through one of the appropriate contacts 82, 83 or 84 to energize the car stopping relay 87 through the circuit including the diode 85 and the resistor 88. Contacts of the relay 87 in the call pick-up circuits operate to command the elevator car to stop and to supply a control signal to the gate circuit 72' to render the controlled rectifier 68' conductive. A cancelling signal is thereafter supplied by the controlled rectifier 68' through the diode 86 and the appropriate closed contacts 82, 83 and 84 and through the diode 77 to commutate the controlled rectifier 51' into non-conduction for resetting the circuit for a subsequent operation.

Figure 6:
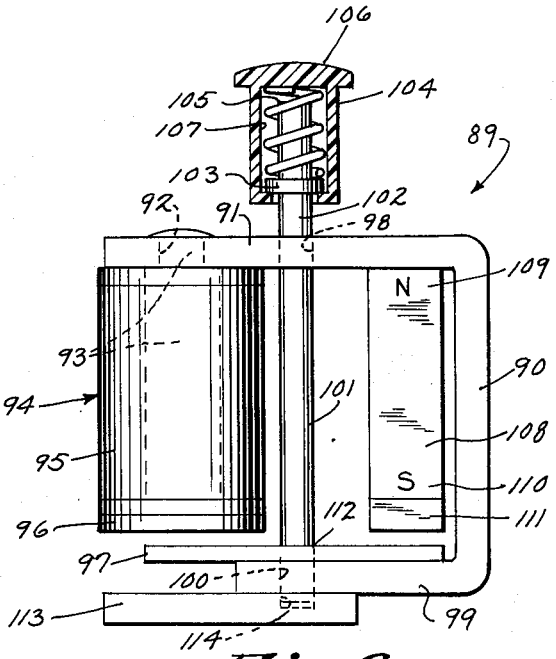
FIG. 6 is an alternative embodiment illustrating a signaling apparatus which may be employed with the signaling systems in FIGS. 4 or 5.

An alternative signaling apparatus 89 is illustrated in FIG. 6 in diagrammatic form. Specifically, a U-shaped flux conducting member 90 includes a first leg 91 containing an opening 92 retaining a core element 93 of an electromagnet 94. The core element 93 is surrounded by a coil 95 containing a plurality of turns of electrically conductive wire while the core element 93 provides an outer end 96 disposed to make selective contact with an armature element 97. The leg 91 of the U-shaped element 90 contains an opening 98 while a leg 99 contains an opening 100 with the two openings 98 and 100 adapted to movably receive an operating rod 101 made of non-magnetic material.

An upper portion 102 of rod 101 contains an outer annular projection 103 which retains a coil spring 104. The spring 104 surrounds the outer portion of the operating rod 101 and extends axially outward from an end 105 of rod 101. A push-button housing 106 contains an inner cylindrical opening 107 which surrounds a portion of the end 102 of the operating rod 101 and the coil spring 104 and is movable axially in response to manual operation for correspondingly imparting an axial force to the operating rod 101 through the spring

104.

A permanent magnet 108 provides a north pole 109 connected to the leg portion 91 and a south pole 110 having an outer pole piece 111. The armature 97 is fixedly connected to the operating rod 101 such as at 112 and selectively moves between a lower position in contact with the leg 99 and an upper position in contact with the core element portion 96 and the pole piece 111. A base support 113 is connected to mount the leg 99 and also contains an opening 114 for receiving the operating shaft 101.

The alternative embodiment set forth in FIG. 6 is shown in a condition in which the button 106 has been manually operated to separate the armature 97 from the core 96 of the electromagnet 94 and the permanent magnet 108. Upon release of the button 106, the armature 97 is attracted toward and moves to contact the magnet 108 and the core 96 through the magnetic force of magnet 108 to complete a flux conducting circuit from the core 93 of the electromagnet 94 through the leg 91 of the U-shaped member 90, the north pole 109 and the south pole 110 of the permanent magnet 108, the pole piece 111 and the armature 97 which completes the path to the core 93.

Downward axial force placed upon button 106 compresses the helically spring 104 thus exerting a downward axial force upon the annular projection 103. Initial pressure upon button 106 fails to move the operating rod 101 because of the magnetic attraction between the armature 97 and the permanent magnet 108. When a predetermined axial force is applied to the button 106, the armature 97 and the interconnected operating rod 101 rapidly descends to separate the armature 97 from both the core 96 and the pole piece 111. With such a separation, the flux rapidly collapses within the core 93 to provide a highly desirable output pulse generated within the coil 95 to render the controlled rectifier 51 conductive. The central location of the operating rod 101 spaced between the electromagnet 94 and the permanent magnet 108 provides uniform operating pressure to both ends of the armature 97. Such a balanced construction permits uniform movement of the armature 97 from both the core portion 96 and the pole piece 111 to ensure a rapid collapse of flux within the core element 93.

Figure 7:
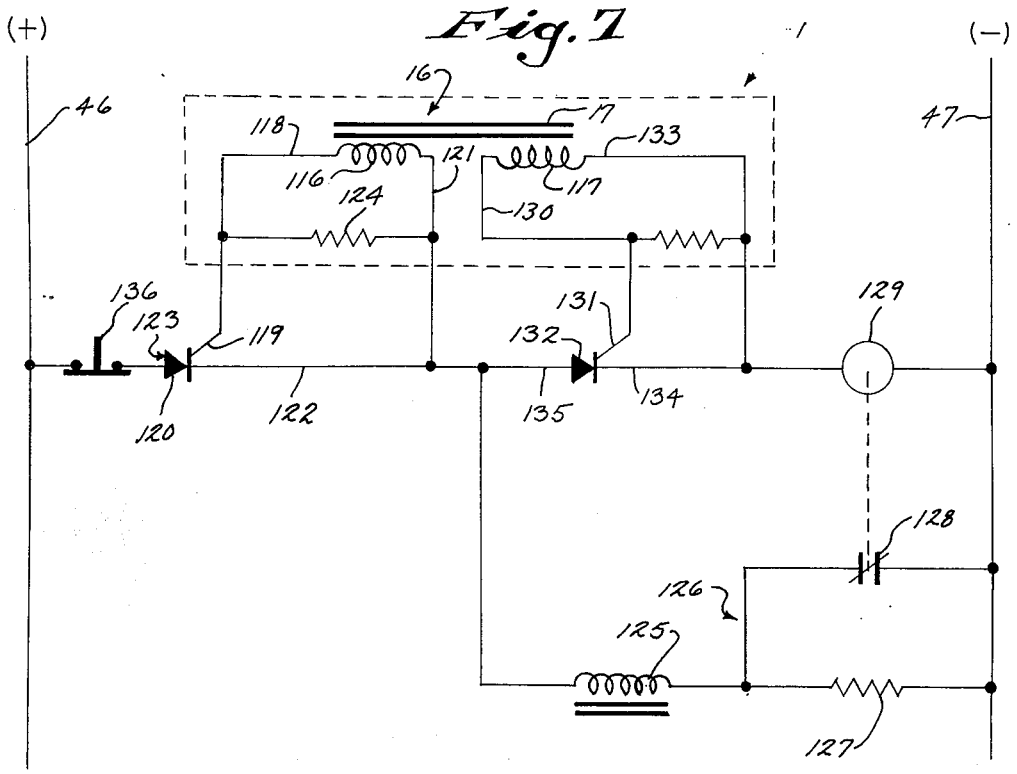
FIG. 7 is an electrical circuit schematic showing a modified signaling system for an emergency stop sequence which uses a slightly modified signaling apparatus of either FIGS. 1 or 6.

FIG. 7 shows an emergency stop apparatus which employs a modified construction of the electromagnet 16 of the signaling apparatus 1 as illustrated in circuit diagrammatic form in an across-the-line circuit configuration. Specifically, the coil 19 of the electromagnet 16 is replaced by a first coil 116 having a winding wound in a first direction about a portion of the core member 17 and a second coil 117 having a winding wound in a second direction about a portion of the core member 17. One output lead 118 of the coil 116 is connected to a gating circuit 119 of a controlled rectifier 120 while a second output lead 121 of the coil 116 is connected to a cathode circuit 122 of the controlled rectifier 120. An anode circuit 123 of the controlled rectifier 120 is connected to a positive constant potential voltage source lead such as at 46 while a resistor 124 is connected between the gating circuit 119 and the cathode circuit 122 in a conventional configuration.

The cathode circuit 122 of the controlled rectifier 120 is connected to a brake solenoid coil 125 operatively controlling a brake shoe selectively engaging a drive shaft coupling a drive motor outpput and an elevator sheave to control the movement of an elevator car. A brake operating solenoid coil such as shown in U.S. Pat. Nos. 2,994,025 and 3,613,835 could be modified to set the corresponding brake shoe when energized and release the brake shoe when de-energized through appropriate biasing for use with the embodiment in FIG. 7. The brake coil 125 is also connected to a negative constant potential voltage source lead such as at 47 through a parallel connected circuit 126 including a resistor 127 and a set of normally closed relay contacts 128 of a relay 129.

The coil 117 includes one output lead 130 which is connected to a gating circuit 131 of a controlled rectifier 132 while another output lead 133 is connected to a cathode circuit 134 of the controlled rectifer 132. The controlled rectifier 132 provides an anode circuit 135 connected to the cathode circuit 122 of the controlled rectifier 120 while a cathode circuit 134 is connected to the relay coil 129 which, in turn, is connected to the negative voltage source lead 47.

In operation, manual movement of a push-button such as at 7 from an un-actuated position to an actuated position produces a forward output pulse of a first polarity in coil 116 and a forward output pulse of a second polarity opposite to the first polarity in coil 117 in accordance with the previously described functioning of the apparatus of FIGS. 1 – 3. In that coil 116 is wound in the first direction, the first polarity pulse is effective to render the controlled rectifier 120 conductive to complete an energizing path from the positive voltage source lead 46 through the controlled rectifier 120, the brake solenoid coil 125 and the normally closed contacts 128 to the negative voltage source lead 47. The initial conduction of current through the solenoid energizing coil 125 is designed to be of a substantial magnitude to quickly set the brake but which would possibly burn out and destroy the solenoid coil 125 if permitted to continue for a predetermined time. The forward second polarity pulse produced within the coil 117 by the transfer of the button 7 from the unactuated position to the fully actuated position maintains the controlled rectifier 132 non-conductive.

The manual release of the push-button 7 effects a transfer from the actuated position to the un-actuated position by the action of the permanent magnet thereby providing a reverse pulse of a second polarity within the coil 116 and another reverse pulse of a first polarity within the coil 117. The reverse second polarity pulse has no operating effect upon the controlled rectifier 120 which remains conductive while the reverse first polarity pulse applied to the gating circuit 131 renders the controlled rectifier 132 conductive thereby energizing the relay 129. The energization of relay 129 opens the contacts 128 to operatively connect the resistor 127 to the brake solenoid coil 125. The opening of the contacts 128 reduces the current flow through the relay 125 to a predetermined magnitude for continued brake setting operation without fear of burning out the brake coil. A normally closed manual switch 136 is selectively operated to open circuit the input to the controlled rectifiers 120 and 132 for resetting the circuit for subsequent operations. The signaling apparatus utilizing the embodiments of FIGS. 1 – 3 as modified in accordance with FIG. 7 can be incorporated in a highly desirable signaling system to provide an emergency stop operation wherein the manual operation of a button such as at 7 is effective for energizing a brake solenoid coil 125 to set a safety brake for stopping an elevator car under an emergency type condition. It should also be noted that the forward and reverse pulses as described herein could also be utilized in modified form by one skilled in the art to perform other signaling operations.

Figure 8:
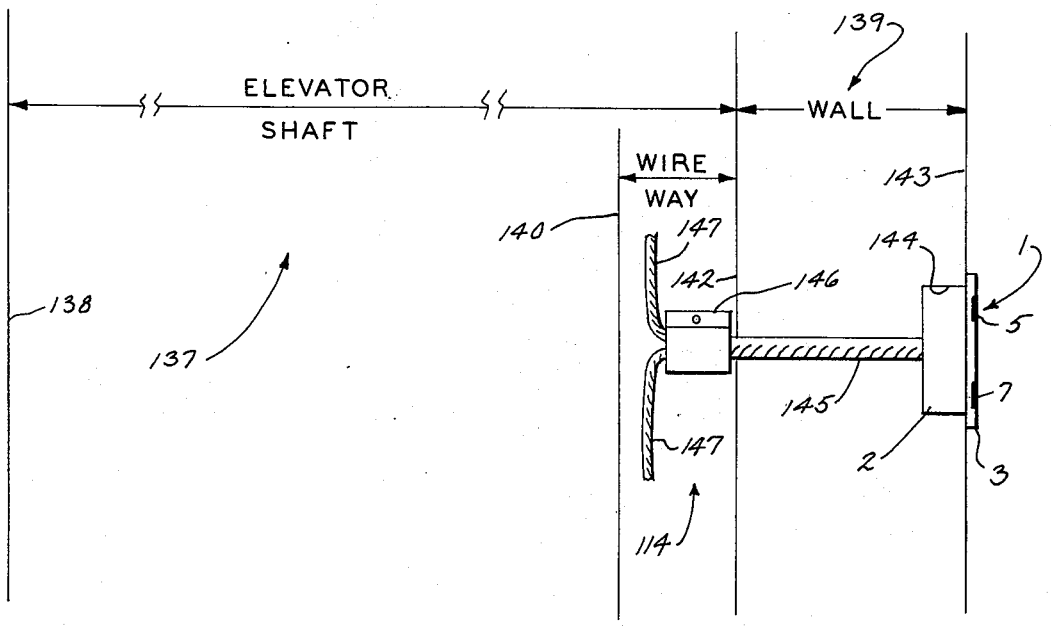
FIG. 8 is an elevational view showing an elevator shaftway construction in diagrammatical form and illustrating one possible and desirable location of the signaling apparatus and the signaling system of the invention.

FIG. 8 diagrammatically illustrates a preferred construction for employing the signaling system at a landing. Specifically, an elevator shaft way 137 is located between a first wall 138 and a second wall 139 while an intermediate wall 140 is spaced a short distance from wall 139 for defining a wireway 141. In a practical construction, the wall 140 may be spaced only a small number of inches from the wall 139 so that the wireway 141 provides space for containing control cables or the like while an elevator car (not shown) is mounted for selective movement within the elevator shaft 137 between the walls 138 and 140. The wall 139 is generally constructed of substantial thickness and provides an outer face 142 adjacent to the wire way 141 and an outer face 143 which is exposed to a landing or floor for view by prospective passengers.

The signaling apparatus 1 is mounted within an opening 144 of the wall 139 so that the outer face plate 3 and the manual push-buttons 5 and 7 are exposed to the view of prospective passengers located at the landing. The base member 2 is received within the opening 144 while a conduit 145 extends through the wall 139 to connect the signaling apparatus 1 with a circuit box or container 146 located within the wire way 141. The box 146 contains the controlled rectifier such as at 51 and the circuitry associated therewith, for example. The leads such as at 20 and 21 associated with the push-button 7 and the associated leads for the push-button 5 together with grounding leads if needed are contained within the circuit conduit 145 and connect the signaling apparatus 1 with the circuit box 146. A plurality of output wires or cables are illustrated at 147 and connect the circuit box 146 to similar circuit boxes located at adjacent floors and possibly to control circuitry located at a central location, such as at a penthouse.

The remote location of the controlled rectifier such as at 51 within the wire way 141 and separated from the landing by the wall 139 provides a highly desirable construction for safe operation in the event of a fire at the landing. The possible melting or short-circuiting of the leads such as 20 and 21 within the conduit 145 will not render the controlled rectifier 51 located within the conduit box 146 conductive and thus will not provide a false call to stop an elevator car. The wall 139 generally acts as a good heat insulator and protects the controlled rectifier 51 located within the conduit box 146. In the event the temperature at or near the conduit box 146 increases, the thermo-protector or heat sensitive fuse 53 will provide an open circuit between the positive potential input at lead 46 and the controlled rectifier 51 to prevent any opportunity for excessive heat to cause a short circuit across the controlled rectifier 51.

Although the preferred signaling apparatus has been specifically described with respect to up or down hall call buttons, it is understood that a single button could be utilized in accordance with the invention at any location such as within the car or at a central control station. Such a system in both the preferred and alternate embodiments provides a manually operable operator or button to selectively supply a highly desirable output pulse thus providing a manually operable current source. It should be understood that either the forward pulse or the reverse pulse can be used for control purposes or that possibly both pulses can be utilized for control. The signaling apparatus provides a distinct advantage in that the controlled rectifier providing the signaling output is reset in response to the stopping of an elevator car at the requisite floor even if the manual button has been accidently or deliberately stuck in the actuated condition. The provision of a signaling output in response to manual movement of a call button ensures a safe operation of the system by preventing false calls through short circuits or the like such as when the building is on fire.

Various modes of carrying out the invention are contemplated as being within the scope of the following claims particularly pointing out and distinctly claiming the subject matter which is regarded as the invention.

I claim:

1. An elevator system connected to a structure having a plurality of landings comprising an elevator car, means mounting said car for movement relative to the structure to serve said landings, and control means moving said car and stopping said car, said control means including signaling means having means providing first and second permanent magnetic poles, output means including core means electromagnetically coupled to coil means and selectively providing a signaling output, flux conducting means connecting said core means and said first pole, and means pivotally connected to said core means and including a first portion magnetically coupled to said core means and to said second pole and a second portion including resilient means selectively manually actuated and rapidly varying the magnetic coupling between said first portion and said second pole to provide said signaling output indicative of the manual operation.

2. The elevator system of claim 1, wherein said first portion includes a pivotal member having a first end rotatably connected to said core means and a second end magnetically attracted to and normally engaging said second pole for conducting flux between said core means and said second pole, and said resilient means including an elongated flexible member having a first end fixedly connected to an intermediate portion of said pivotal member and a second end adapted for manual actuation to rapidly rotate said pivotal member and disengage said second end from said second pole and provide said signaling output.

3. The elevator system of claim 1, wherein said signaling means includes shunt means connected to said core means and spaced from said second pole, said first portion selectively rotated to reduce the magnetic coupling with said second pole and engage said shunt means and provide a shunting path for said core means in response to the manual actuation of said resilient means.

4. The elevator system of claim 3, wherein said control means includes first and second signaling means adjacently mounted at each landing for indicating up and down direction demand for elevator service respectively and separated by shielding means, said shunt means including a portion of said shielding means.

5. The elevator system of claim 1, wherein said control means includes a predetermined number of said signaling means each corresponding to a selected one of said landings and stopping means operatively responding to one of said signaling outputs and stopping said elevator car at one of said selected landings.

6. The elevator system of claim 1, wherein said output means includes controlled rectifier means having gating means electrically connected to said coil means and selectively rendered conductive in response to the rapid variation of the magnetic coupling between said first portion and said second pole through the manual actuation of said resilient means.

7. The elevator system of claim 6, wherein said control means includes position sensing means responding to the stopping of said elevator car at one of said selected landings in response to said signaling output to actuate resetting means operable to render said controlled rectifier non-conductive.

8. The elevator system of claim 6, wherein at least one of said landings includes a separating wall providing a first side facing prospective passengers and a second side facing an elevator shaft, said core means mounted adjacent to said first side and said controlled rectifier means located adjacent said second side.

9. An elevator system connected to a structure having a plurality of landings comprising an elevator car, means mounting said car for movement relative to the structure to serve said landings, and control means moving said car and stopping said car at said landings, said control means including signaling means having means providing first and second permanent magnetic poles, output means including core means electromagnetically coupled to coil means and selectively providing a signaling output, flux conducting means connecting said core means and said first pole, an armature member magnetically coupled to said core means and said second pole, and operator means connected to an intermediate portion of said armature member spaced between said core means and said second pole and selectively manually actuated to move said armature member from a first position providing a flux conducting path between said core means and said second pole and a second position to open said flux conducting path and provide said signaling output.

10. The elevator system of claim 9, wherein said operator means includes spring means operatively connected to said intermediate portion and selectively manually actuated to rapidly transfer said armature member to said second position.

11. The elevator system of claim 9, wherein said spring means includes an elongated flexible member having a first end fixedly connected to said intermediate portion and a second end spaced from said output means and adapted for manual actuation.

12. An elevator system connected to a structure having a plurality of landings comprising an elevator car, means mounting said car for movement relative to the structure to serve said landings, and control means moving said car and stopping said car at said landings, said control means including signaling means having means providing first and second permanent magnetic poles, output means including core means electromagnetically coupled to coil means and selectively providing a signaling output, a U-shaped unitary member having first and second legs each including aligned guide openings with said first leg connecting said core means and said first pole for conducting flux therebetween, an armature member magnetically coupled to said core means and said second pole, and operator means including a shaft movably positioned within said guide openings and fixedly connected to said armature member and spring means connected to said shaft and selectively manually actuated to move said armature member from a first position connecting said core means and said second pole to a second position spaced from said core means and said second pole to provide said signaling output.

13. An elevator system connected to a structure having a plurality of landings comprising an elevator car, means mounting said car for movement relative to the structure to serve said landings, at least one of said landings including a separating wall having a first side facing prospective passengers and a second side facing an elevator shaft, and control means moving said car and stopping said car including signaling means having manually operable current source means mounted adjacent said first side and electrically connected to an electrical static element located adjacent said second side and selectively providing a signaling output in response to the manual operation of said current source means.

14. The elevator system of claim 13, wherein said manually operable current source means includes means providing first and second permanent magnetic poles, core means electromagnetically coupled to coil means selectively providing an electrical output to said static switching means, first flux conducting means connecting said core means and said first pole, and second flus conducting means magnetically coupling said core means and said second pole and selectively manually operated to vary the conduction of magnetic flux therethrough for providing said signaling output.

15. The elevator system of claim 14, wherein said static element includes controlled rectifier means having gating circuit means electrically connected to said coil means.

16. The elevator system of claim 13, wherein said static element is conntect in a signaling circuit including electrical power source means and a heat sensitive switch selectively disconnecting said static element from said source means in response to a predetermined temperature.

17. The elevator system of claim 16, wherein said heat sensitive switch is mounted adjacent said second side of said wall.

18. An elevator system connected to a structure having a plurality of landings comprising an elevator car, means mounting said car for movement relative to the structure to serve said landings, and control means moving said car and stopping said car, said control means including signaling means having means providing first and second permanent magnetic poles, output means including core means electromagnetically coupled to coil means and selectively providing first and second signaling outputs, first flux conducting means connecting said core means and said first pole, and second flux conducting means magnetically coupling said core means and said second pole and selectively manually operated from a first position conducting a first predetermined flux to a second position conducting a second predetermined flux and providing said first signaling output and from said second position to said first position and providing said second signaling output.

19. The elevator system of claim 18, and including means connected to bias said second flux conducting means to said first position.

20. The elevator system of claim 18, wherein said coil means includes a first winding for providing said first signaling output and a second winding for providing said second signaling output.

21. The elevator system of claim 20, wherein said output means includes a first electrical static switching element electrically connected to said first winding and a second electrical static switching element electrically connected to said second winding.

22. The elevator system of claim 20, wherein said first and second windings are oppositely wound.

* * * * *